US005651488A

United States Patent [19]

Goretzky

[11] Patent Number: 5,651,488

[45] Date of Patent: Jul. 29, 1997

[54] PRESSURE-ROLLER ARRANGEMENT FOR A STACKING DEVICE OF A PRINTER OR COPIER

[75] Inventor: Michael Goretzky, Fraunberg, Germany

[73] Assignee: Océ Printing Systems GmbH, Poing, Germany

[21] Appl. No.: 553,403

[22] PCT Filed: May 9, 1994

[86] PCT No.: PCT/DE94/00532

§ 371 Date: Nov. 20, 1995

§ 102(e) Date: Nov. 20, 1995

[87] PCT Pub. No.: WO94/26643

PCT Pub. Date: Nov. 24, 1994

[30] Foreign Application Priority Data

May 19, 1993 [DE] Germany ..... 43 16 873.6

[51] Int. Cl.[6] ..... B65H 20/00; B65H 57/14

[52] U.S. Cl. ..... 226/190; 226/194; 242/615.2

[58] Field of Search ..... 226/190, 194, 226/181; 242/615.2; 254/416

[56] References Cited

U.S. PATENT DOCUMENTS

| | | | |
|---|---|---|---|
| 3,411,686 | 11/1968 | Bender . | |
| 3,586,229 | 6/1971 | Kamada et al. . | |
| 4,770,550 | 9/1988 | Takahashi | 226/194 |
| 4,842,180 | 6/1989 | Kato | 226/190 |
| 4,953,846 | 9/1990 | Azeta et al. . | |
| 5,273,197 | 12/1993 | Wenk | 226/190 |

FOREIGN PATENT DOCUMENTS

| | | | |
|---|---|---|---|
| 0 466 691 | 3/1993 | European Pat. Off. . | |
| 26 17 334 | 12/1988 | Germany . | |
| 0271349 | 10/1989 | Japan | 226/190 |
| 1189709 | 4/1970 | United Kingdom . | |

OTHER PUBLICATIONS

*IBM Technical Disclosure Bulletin*, vol. 30, No. 5, Oct. 1987, pp. 339–340.

*IBM Technical Disclosure Bulletin*, vol. 15, No. 4, Sep. 1972, p. 1253.

*Primary Examiner*—Daniel P. Stodola

*Assistant Examiner*—Matthew A. Kaness

*Attorney, Agent, or Firm*—Hill, Steadman & Simpson

[57] ABSTRACT

A stacking device in a printer or copier for stacking a strip-like, prefolded recording medium has, as feed arrangement, a motor-driven feed roller (13) and a plurality of adjacently arranged pressure rollers for pressing the recording medium (10) against the feed roller (13). The two outer pressure rollers (16/1, 16/2) in respect of the edge regions of the recording medium are designed as guide pressure rollers which change their inclination of the axes of rotation in dependence on the transporting direction of the paper or recording medium and thus make the recording medium taut between the guide pressure rollers. This prevents undesirable bunching, creasing or deformation caused by slack in the paper between the pressure rollers. In order to achieve this change in the inclination of the axes of rotation, the guide pressure rollers (16/1, 16/2) contain an eccentric axle arrangement.

15 Claims, 5 Drawing Sheets

PRESSURE-ROLLER ARRANGEMENT FOR A STACKING DEVICE OF A PRINTER OR COPIER

BACKGROUND OF THE INVENTION

The invention relates to an apparatus for the distortion-free back-and-forth transporting of a recording medium of an imaging machine such as a printer or copier between a counter-bearing, which receives the recording medium, and a plurality of adjacently arranged pressure rollers which press the recording medium against the counter-bearing.

In electrographic high-speed printers operating with continuous paper, stacking devices are used for stacking the printed continuous paper, such as are described, for example, in DE-C2-26 17 334. For stacking the recording medium on a stacking surface, a transporting device is arranged above the stacking surface, which transporting device comprises a transporting roller and a pressure roller between which the recording medium is transported by friction.

In order to achieve an even contact and guiding of the paper, it is also customary, instead of a continuous pressure roller, to arrange a plurality of individual pressure rollers adjacently, which press the recording medium against the transporting roller. Owing to the design, between these pressure rollers there is a gap in which the paper is not pressed on.

In order that the recording medium, consisting for example of prefolded continuous paper, can be placed securely on the delivery surface in the form of a stack, the recording medium must be fed to the delivery surface in an unstressed state. This means that the recording medium must roll along the stack below the feed device so that a zigzag stack can be formed automatically.

Electrographic printing devices must be constructed in such a way that they can be used to print on recording media of the widest variety of types, including thin and thick prefolded paper. There is thus the risk, in particular when using relatively thin prefolded paper, that the paper will form a groove in the region between the pressure rollers when passing through the feed device in the stacking device, which makes creasing in the fold and rolling of the paper more difficult. This groove in the paper, as illustrated in FIG. 2, is produced due to the fact that the paper is pushed together between the pressure rollers as a result of the contact pressure of the pressure rollers.

This groove formation can be avoided if the paper is drawn outwards at the sides and is thus made taut in the region of the pressure rollers. In order to achieve this, it has already been proposed to mount the outer pressure rollers with a slightly inclined axis in such a way that the pressure rollers exert an outward tensile force on the recording medium. This transverse force thus produced between the outer pressure rollers makes the recording medium taut in the region located between them.

Electrographic printing devices operate at very high printing speeds of 200 sheets per minute and higher. In order that no tearing of the recording medium occurs when the printing device has to be stopped, the printing device must not be stopped abruptly, but it is braked with a specific deceleration. The section of the recording medium which continues to be transported during this braking phase must subsequently be drawn back again for the next start-up of printing so that printing on the recording medium in the correct position is guaranteed.

During this drawing-back of the recording medium, however, the oblique setting of the outer pressure rollers now leads to the recording medium being pushed together between the pressure rollers, which can cause faulty stacking at the next start-up of printing. This is disadvantageous particularly in the case of frequent start-stop operation.

This problem also occurs in other printing devices which operate, for example, with large-format single sheets, and in which it is necessary to move the recording medium back and forth in a printing or transporting channel.

An electrographic printing device for two-sided printing of single sheets is known from U.S. Pat. No. 4,953,846. For this purpose, the single sheet is firstly printed in the printing station on the front, is fed via a separate return channel to a turning device, is turned there, is laterally offset by means of an obliquely set guide roller and is then printed on the back. A transporting device is used to transport the single sheets, which transporting device comprises a motor-driven transporting roller and a pressure roller which presses the single sheets resiliently against the transporting roller. In order that the pressure roller can follow the deflection of the single sheet, it is mounted in a bearing body so as to be horizontally displaceable with its axis of rotation loose at one end. In this way, the pressure roller is prevented from exerting guiding forces on the single sheets.

An object of the invention is to design a guide pressure roller for a recording medium, in friction-contact with the guide pressure rollers, of a printer or copier in such a way that, on the one hand, the angle of the axis of rotation of the guide pressure roller relative to the transporting direction of the recording medium changes in dependence on the direction of rotation of the guide pressure rollers and, in so doing, guide forces are exerted on the recording medium and, on the other hand, the guide pressure rollers is guided precisely.

A further object of the invention is to provide an apparatus for the back-and-forth transporting of a recording medium of a printer or copier between a counter-bearing, which receives the recording medium, and a plurality of adjacently arranged pressure rollers which press the recording medium against the counter-bearing, in which no distortion, for example by groove formation, occurs between the pressure rollers.

SUMMARY OF THE INVENTION

The objects are achieved by providing a self-adjusting guide pressure roller which is frictionally contactable against a reversibly transportable paper. The guide pressure roller has a roller axle with a skewed axis of rotation which reversibly self-adjusts to correspond to a transport direction of the paper.

The guide pressure roller includes a roller body contactable against the paper, the roller axle on which the roller body rotatably bears, and a stationary axle on which the roller axle is mounted. The stationary axle extends through the roller axle on a skewed or eccentric axis relative to a central axis of the roller axle. The roller axle is rotatable only between two stop positions.

A friction moment between the roller body and the roller axle is greater than a friction moment between the roller axle and the stationary axle so that the roller axle moves between the stop positions, such that each stop position is associated with a predetermined orientation of the guide roller bearing. The rolling axis of the roller body is maintained in an orientation slightly nonperpendicular to the paper transport direction so that the guide pressure roller frictionally tightens the paper.

In an embodiment, the stop positions are defined by two projections extending from one end of the roller axle. The stationary axle is mounted to an attachment element, and the projections are contactable against the attachment element at the respective stop positions.

According to an aspect of the present invention, the guide pressure roller is arranged in an imaging machine, such as a printer or copier. The machine includes a drivable feed roller for reversibly moving the paper selectively along a forward and backward transport direction. At least one, and preferably multiple, conventional pressure rollers are contactable against the paper to pressing the paper against the feed roller. Each of the conventional pressure rollers has a fixed and noneccentric axis of rotation. At least one guide pressure roller frictionally is contactable against the paper and also presses the paper against the feed roller.

In an embodiment, the imaging machine includes at least one cooperating pair of the guide pressure rollers. The guide pressure rollers of the pair are arranged near opposite edges of a side of the paper. The guide pressure rollers of the pair have oppositely oriented roller bearings such that the guide pressure rollers frictionally tighten the paper between each other. In another embodiment, the paper has one edge with perforations along which the paper is guided. A guide pressure roller is located opposite the edge perforations for tightening the paper.

In the transporting apparatus according to the invention, guide pressure rollers are used as outer pressure rollers, whose angular setting relative to the transporting direction of the recording medium depends on the direction of rotation of the pressure rollers. The recording medium is thus made taut during the forward and backward movement of the recording medium and groove formation is avoided.

The guide pressure rollers are mounted on a roller axle as bearing element. The roller axle, in turn, contains an oblique internal bore in which a rigid axle is inserted, about which the roller axle can rotate through a particular angular amount between two stop positions. The arrangement thus forms a type of eccentric.

In order that the guide pressure rollers automatically assume their angular position producing transverse force, the friction moments of the bearings are selected such that the friction moment between the actual guide pressure roller and the roller axle is greater than the friction moment between the roller axle and the rigid stationary axle. During a rotary movement of the guide pressure roller, the roller axle is thus carried along between the stops into the defined stop position. This distribution of friction moments is achieved by a difference in the diameters of the bearing points.

The invention makes reliable stacking of the recording medium possible in a simple manner, even in start-stop operation.

Additional features and advantages of the present invention are described in, and will be apparent from, the detailed description of the presently preferred embodiments and from the drawings.

BRIEF DESCRIPTION OF THE DRAWINGS

Embodiments of the invention are illustrated in the drawings and will be described in greater detail below by way of an example.

DETAILED DESCRIPTION OF THE PRESENTLY PREFERRED EMBODIMENTS

Figure 1:
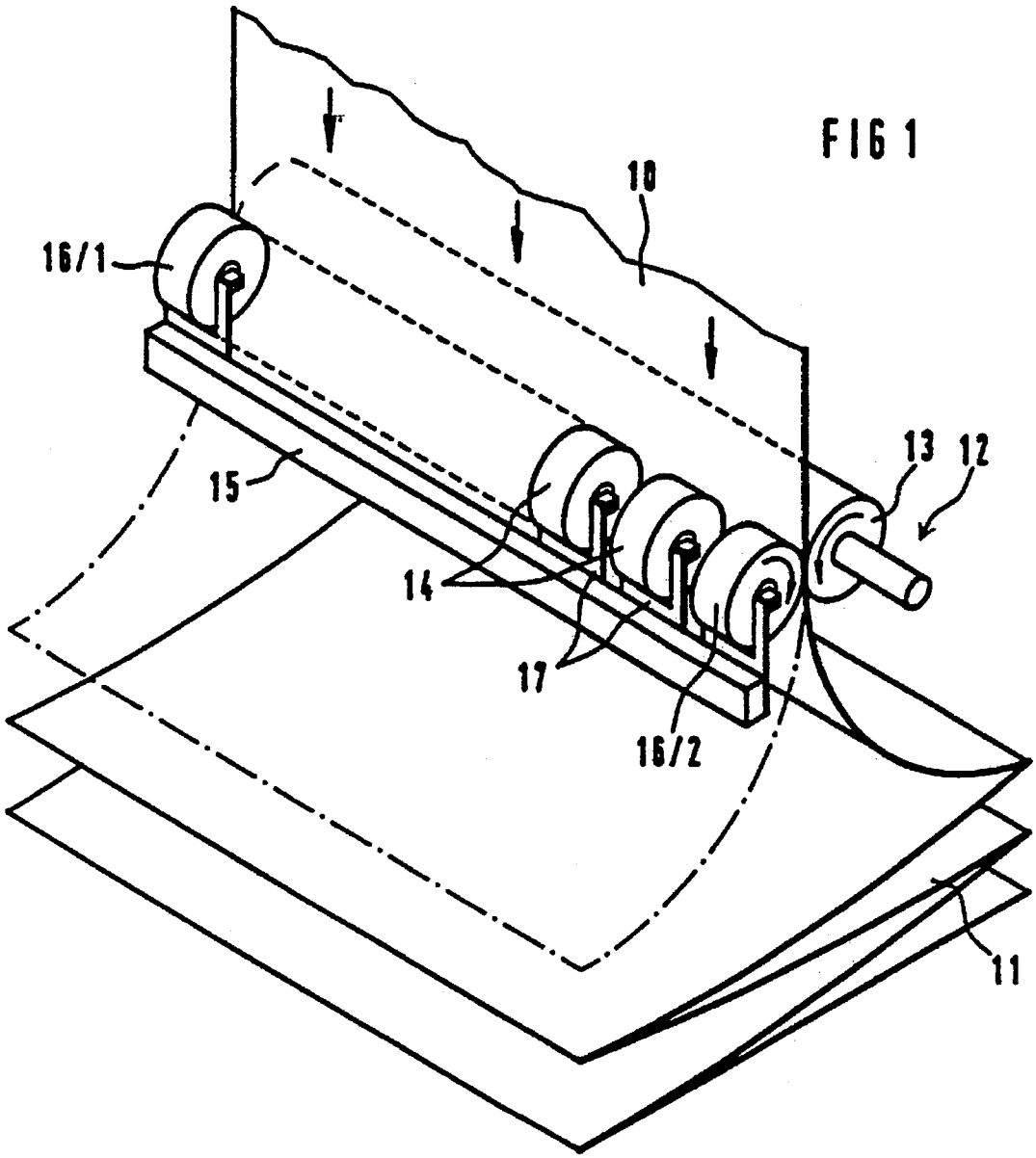
FIG. 1 is a schematic isometric view of a stacking device for an electrographic printing device operating with continuous paper.

A printing machine (not illustrated here in detail) operating on the principle of electrophotography, such as is known, for example, from EP-B1-04 66 691, uses a prefolded web 10 of continuous paper as recording medium. After printing and fusing, the recording medium 10 is stacked in a stacking device (FIG. 1) at the outlet of the printing device. This stacking device contains a stationary receiving surface on which the stack 11 is stacked in the form of a zigzag web, a recording medium feed arrangement 12, which changes its position in dependence on the stack height, feeding the recording medium 10 to the delivery table. The feed arrangement contains a motor-driven feed roller 13 which extends over the width of the recording medium and can consist, for example, of hard rubber. The recording medium 10 is guided with its back over this feed roller 13, the feed roller 13 serving as counter-bearing. The recording medium 10 is pressed against the feed roller 13 by means of a multiplicity of free-running pressure rollers 14 which are arranged adjacently with a spacing A on a holding device in the form of a holding strip 15. Each of the pressure rollers 14 is mounted on a leaf spring 17 (FIGS. 6 and 8) which, in turn, is attached to the holding strip 15 by means of screws or other attachment elements. The two outer pressure rollers 16/1 and 16/2, disposed at the edge regions of the recording medium 10, are designed as guide pressure rollers which change their angular setting relative to the transporting direction of the recording medium in dependence on the transporting direction. They are described below. The central pressure rollers 14 are mounted in a conventional manner so as to be freely rotatable on an axle which is firmly clamped between the arms of the leaf springs 17.

Figure 2:
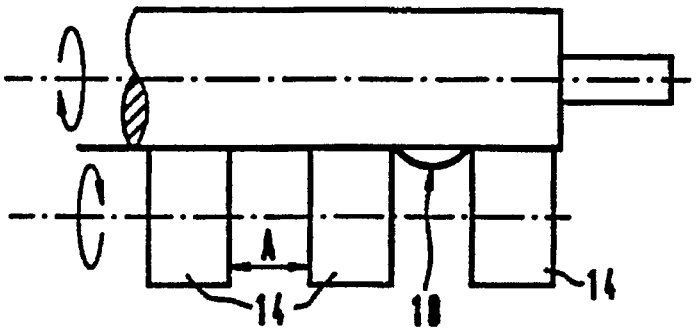
FIG 2 (PRIOR ART)
FIG. 2 is a schematic plan view of a possible groove formation between two pressure rollers in the prior art.

In normal operation (FIG. 1) of the printing device, the recording medium 10 is fed over the feed roller 13 to the stack 11 in the direction of the arrow. If only conventional rigidly arranged pressure rollers are used as pressure rollers 14 in accordance with the prior art illustration of FIG. 2, a groove 18 or slack bunched area forms on the recording medium 10 between the pressure rollers 14; this groove impedes the stacking and leads to faulty stacking, since the paper and thus also the paper fold are distorted.

If the electrographic printing device is stopped, it is necessary, to avoid the tearing of the recording medium, to brake the paper evenly and not to stop it abruptly. When continuing the printing operation, it is therefore necessary to return the recording medium 10 to its original printing position, for which reason the recording medium is fed back, by reversing the direction of rotation of the feed roller 13, over a particular section which depends on the braking path. In this case, too, a groove formation 18 would again occur in the case of a rigid arrangement of the pressure rollers 14.

In order to avoid this, according to the invention the two outer pressure rollers 16/1, 16/2 are designed as angularly movable guide pressure rollers 16/1 and 16/2.

Figure 4:
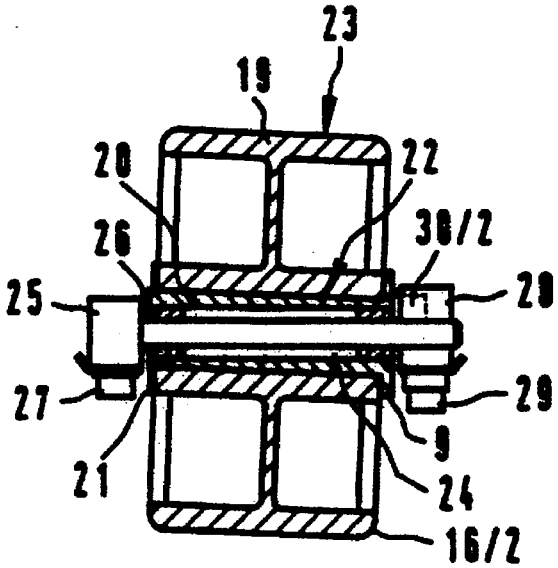
FIG. 4 is a sectional view of a guide pressure roller in a central position with a section perpendicular to the transporting direction of the recording medium.

A guide pressure roller 16/2 illustrated in section in FIG. 4 has a roller body 19 as the actual paper running roller which can be injection molded, for example from plastic material. The roller body 19 is mounted on an integral roller axle 20, illustrated in perspective in FIG. 9. It consists of a cylindrical metal or plastic body with an outer surface as a sliding bearing 22 for the roller body 19, the outer surface and thus the sliding bearing 22 extending parallel to a paper guiding surface 23 on the roller body 19. On one side of the roller axle 20, a guide edge 9 is formed as a contact surface for the roller body 19 and, on the other side, a recess 8 for receiving a securing ring 21.

Figure 9:
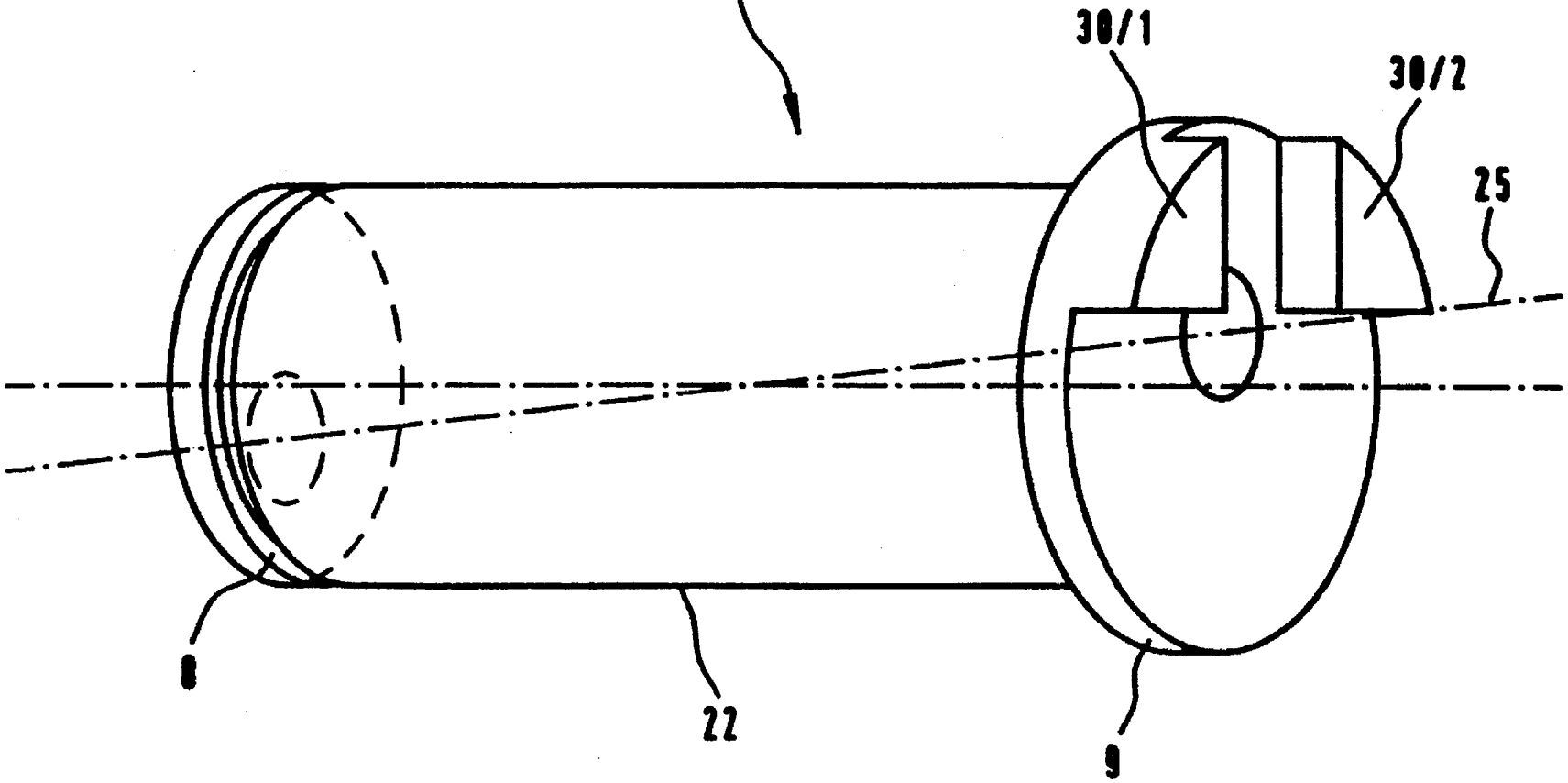
FIG. 9 is an isometric illustration of a roller axle which receives a roller body of the guide pressure roller.

The roller axle 20 contains an oblique internal bore 24 which extends through roller axle 22 obliquely in an eccentric position. Arranged in this internal bore is a rigid stationary axle 25 (only the axis of which is indicated in FIG. 9) with assigned bearing bushes 26 for rotatably receiving the roller axle 20. The rigid axle 25 is of integral design. The axle 25 is attached to the leaf spring 17 at one end by means of an attachment screw 27 and, at the other end, by means of a clamping device comprising a holding block 28 with an associated clamping screw 29. The rotary movement of the roller axle 20 is limited by two upper and lower projections 30/1 and 30/2 (FIG. 3, FIG. 9) which are arranged laterally on the roller axle 20 and interact with stop surfaces 31 arranged on the holding block 28.

Figure 3:
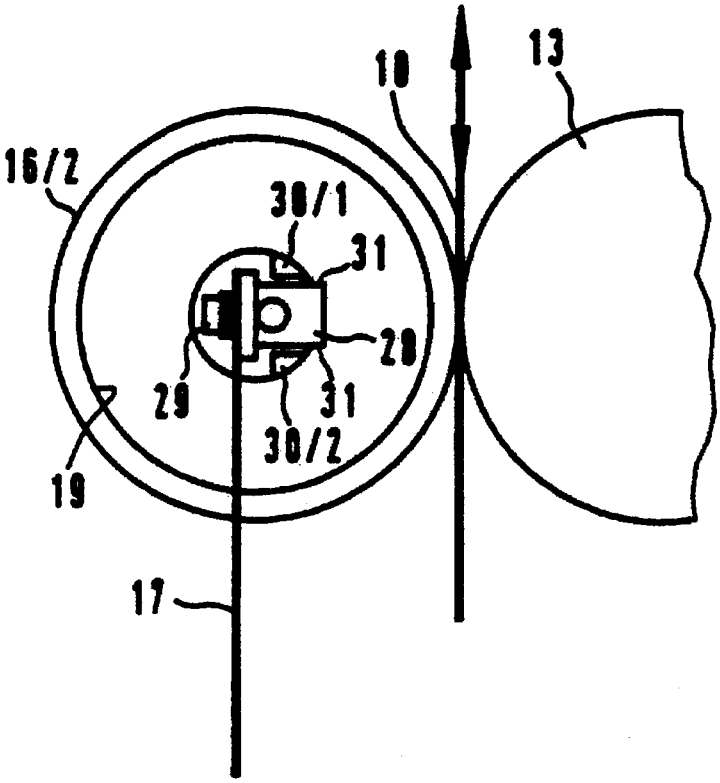
FIG. 3 is a schematic side view of the apparatus according to the invention in a central position of the guide pressure rollers.

In this case, the central position of the bearing arrangement and thus that of the guide pressure roller are illustrated in FIGS. 3 and 4, in which the projections 30/1 and 30/2 are spaced equally from the stop surfaces 31 of the holding block 28. In this central position, the guide pressure-roller arrangement has a position of the axis of rotation which corresponds to the position of the axis of rotation of the central rigid pressure roller 14. It runs perpendicular to the transporting direction of the recording medium and is denoted in FIGS. 6 and 8 by the reference numeral 32.

The eccentric arrangement of the roller axle 20 and rigid axle 25 is now selected such that, starting from the central position of the axis of rotation 32, the angle of the axis of rotation changes in dependence on the direction of rotation of the roller body 19 and thus in dependence on the transporting direction, and thus the position of the roller body 19 changes relative to the recording medium.

Figure 6:
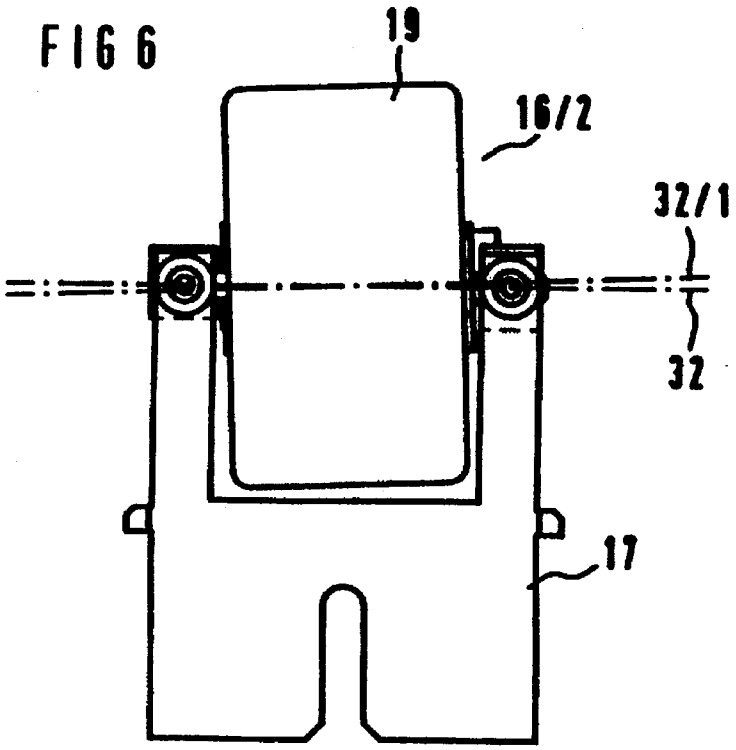
FIG. 6 is a front elevational view of the guide pressure roller on the right-hand side in an angular position corresponding to FIG. 5.
Figure 5:
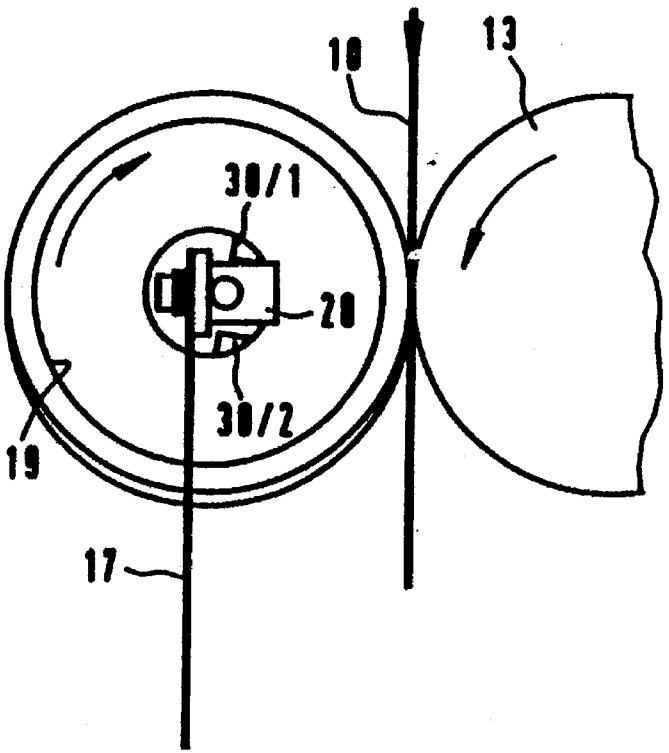
FIG. 5 is a schematic side view of the apparatus in an annular position of the guide pressure rollers, which angular position corresponds to the forward transporting of the recording medium.

If, as illustrated in FIGS. 5 and 6, the recording medium 10 moves downward in the stacking direction, the roller body 19 rotates due to friction in the direction of rotation illustrated in FIG. 5. Starting from the central position of the guide pressure-roller arrangement, the roller axle 20 is carried along during this movement since the friction moment in the region 22 of the sliding bearing between the roller axle 20 and the roller body 19 is greater than the friction moment in the region of the bearing bushes 26, between the rigid axle 25 and the roller axle 20. As a result of the rotary movement, the projection 30/1 is placed against the associated stop surface 31 of the holding block 28, and the guide pressure roller (in this case the right-hand guide pressure roller 16/2) assumes the position drawn in FIG. 6, a position in which, seen in the transporting direction, the axis of rotation 32 is rotated into a position 32/1 of the axis of rotation toward the edges of the recording medium.

Figure 8:
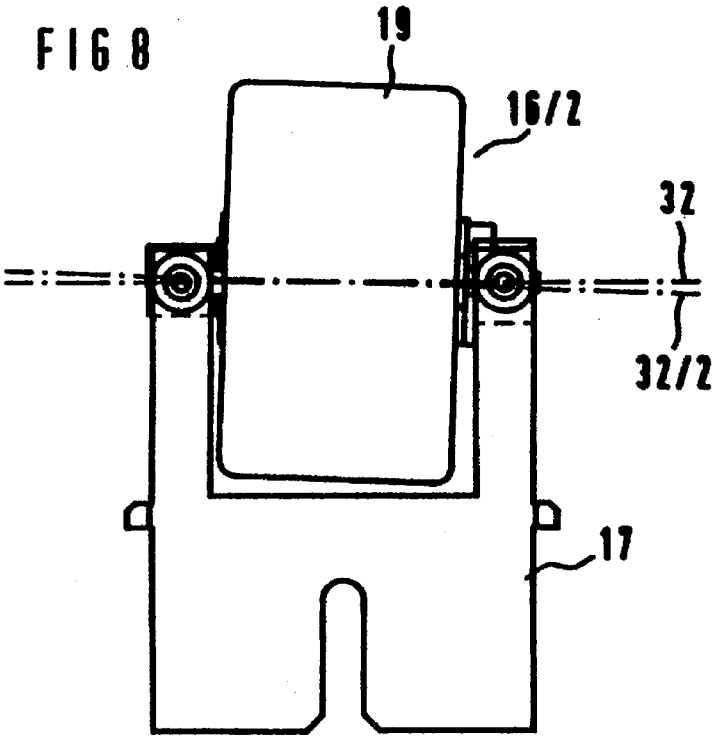
FIG. 8 is a front view of the guide pressure roller on the right-hand side in a functional position corresponding to FIG. 7.

By means of corresponding, reversed arrangement of the guide pressure rollers and their eccentric arrangement, the guide pressure roller 16/1 on the left-hand side is moved into a corresponding rotary-position, likewise directed outward toward the edge of the recording medium, so that it assumes a position corresponding to the position of FIG. 8. By means of these outwardly directed rotary positions of the guide pressure rollers 16/1 and 16/2, the recording medium is subjected to a transverse force in the region between the guide pressure rollers 16/1 and 16/2, which makes the recording medium taut in this region and thus prevents a groove formation between the guide pressure rollers 14 and the guide pressure rollers 16/1 and 16/2.

Figure 7:
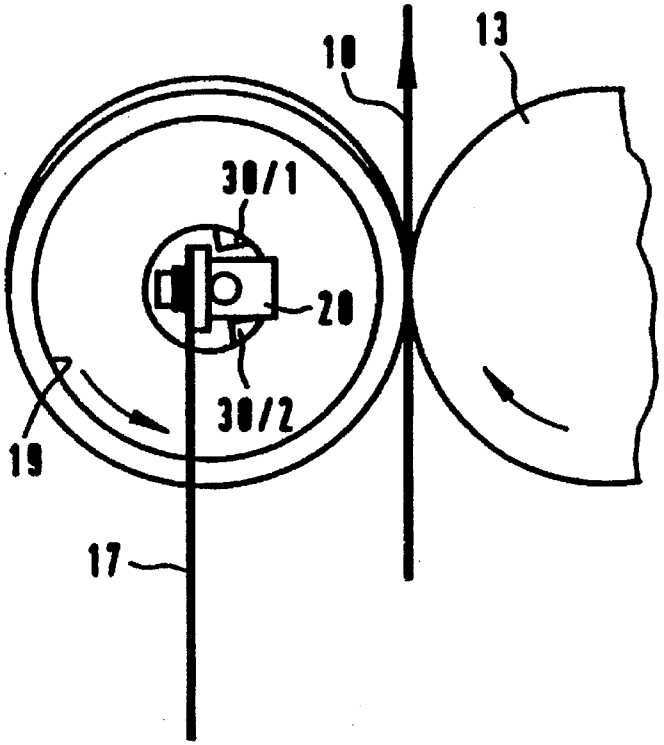
FIG. 7 is a schematic side view of the apparatus in an angular position of the guide pressure rollers, which angular position corresponds to the backward transporting of the recording medium.

When the direction of the recording medium 10 is reversed by changing the drive direction of the feed roller 13, the roller body 19 is rotated, due to friction, counter clockwise corresponding to the illustration of FIG. 7. During the rotation, the friction moment between the roller body 19 and the roller axle 20 carries the roller axle 20 along until the lower projection 30/2 is placed against the stop surface 31 of the holding block 28. The inclination of the axis of rotation has thus also been reversed, corresponding to the illustration of FIG. 8, so that the axis of rotation now assumes the position 32/2 of the axis of rotation. Seen in the transporting direction of the recording medium, the guide pressure rollers 16/1 and 16/2 are again deflected toward the edges of the recording medium. Thus, in this transporting position, too, a transverse force is produced between the guide pressure rollers 16/1 and 16/2, which makes the recording medium taut in the region of the pressure rollers 14.

The ratios of the friction moments in the bearings 22 and 26 are important for the functioning of this automatic displacement of the axes of rotation of the guide pressure rollers in dependence on the transporting direction. In this case, it must be ensured that the friction moment between the roller body 19 and the roller axle 20 is greater than that between the roller axle 20 and the rigid axle 25. This difference is by virtue of the difference in the diameters of the bearing points.

To avoid the groove formation between the pressure rollers, it is sufficient to deflect the guide pressure rollers slightly so that, in the exemplary embodiment illustrated, the change in the angle of the axes of rotation, starting from the central position, is only a few angular degrees, and the spacing between the projections 30/1 and 30/2 end the stop faces 31 is thus a few millimeters. The magnitude of the change in the angle of the axes of rotation depends on the desired transverse force to be achieved and the friction moment between the roller body and the recording medium. In dependence on the range of application of the guide pressure rollers, by appropriate choice of the eccentric arrangement inside the roller body 19 and by selection of the stop region, an appropriate adaptation to the desired degree of deflection can be achieved.

In the exemplary embodiment illustrated, two guide pressure rollers are assigned on both sides to the edge regions of the recording medium within a stacking device. It is also conceivable to use only one guide pressure roller if, for example, the other side of the recording medium is guided firmly by means of edge perforations, or even a plurality of guide pressure rollers if the recording medium involved is a very wide one. It is also conceivable to use the guide pressure rollers for the purpose of moving, for example, a sheet-like recording medium in dependence on the transporting direction and to guide it using said rollers, for example in the context of a single-sheet printing device in the recording-medium transporting channel or for moving the recording medium in the stacking device for each job.

It should be understood that various changes and modifications to the presently preferred embodiments will be apparent to those skilled in the art. Such changes and modifications may be made without changing the spirit and scope of the present invention and without diminishing its attendant advantages. Therefore, such changes and modifications are intended to be covered by the appended claims.

List of Reference Numerals

8 Recess
9 Edge, stop
10 Recording medium, prefolded continuous paper
11 Stack
12 Feed arrangement
13 Feed roller, transporting roller
14 Pressure rollers
A Spacing between pressure rollers
15 Holding strip
16/1,16/2 Guide pressure rollers on the left-hand and right-hand sides
17 Leaf spring
18 Groove, distortion
19 Roller body
20 Roller axle
21 Securing ring
22 Sliding bearing, outer surface
23 Guide surface, contact pressure surface
24 Internal bore
25 Rigid axle
26 Bearing bush
27 Attachment screw
28 Holding block
29 Clamping screw
30/1 Upper projection
30/2 Lower projection
31 Stop surface
32 Central position, axis of rotation
32/1 Position of axis of rotation in stacking operation, forward direction
32/2 Position of axis of rotation when transported back

What is claimed is:

1. A guide pressure roller adapted for guiding a recording medium in friction contact with the guide pressure roller, the recording medium bring reversibly movable along a transporting direction, the guide pressure roller comprising:

a roller body;

a generally cylindrical roller axle on which said roller body rotatably bears; and a stationary axle extending through the roller axle in an eccentric position and on which the roller axle is mounted to be rotatable in a limited manner between two stop positions at which said roller axle engages a stationary holding block, a friction moment between the roller body and the roller axle being greater than a friction moment between the roller axle and the stationary axle so that, when a rotary movement of the roller body is reversed, the roller axle moves relative to the stationary axle between the stop positions before the roller body moves relative to the roller axle, the guide pressure roller having an axis of rotation which is self-changeable relative to said transport direction, each stop position corresponding to a respective orientation of the guide roller bearing on an axis of rotation which is nonperpendicular to the paper transport direction.

2. The guide pressure roller as claimed in claim 1, having projections extending from the roller axle which interact with stop surfaces on an attachment element to which the stationary axle is secured.

3. The guide pressure roller as claimed in claim 1, further comprising a leaf spring elements on which each guide pressure roller is mounted.

4. An imaging device comprising:

a mover for moving a recording medium back and forth between a counter-bearing and a plurality of adjacently arranged pressure rollers which press the recording medium against the counter-bearing;

wherein at least the outermost pressure rollers which rest near opposite edges of the recording medium are a cooperating pair of guide pressure rollers which change their angle of the axes of rotation relative to the transporting direction to correspond to the transporting direction of the recording medium, each of said outermost guide pressure rollers including:

a roller body;

a generally cylindrical roller axle on which said roller body rotatably bears; and a stationary axle extending through the roller axle in an eccentric position and on which the roller axle is mounted to be rotatable in a limited manner between two stop positions at which said roller axle engages a stationary holding block, a friction moment between the roller body and the roller axle being greater than a friction moment between the roller axle and the stationary axle so that, when a rotary movement of the roller body is reversed, the roller axle moves relative to the stationary axle between the stop positions before the roller body moves relative to the roller axle, the guide pressure roller having an axis of rotation which is self-changeable relative to said transport direction, each stop position corresponding to a respective orientation of the guide roller bearing on an axis of rotation which is nonperpendicular to the paper transport direction.

5. The guide pressure roller as claimed in claim 4, wherein the counter-bearing is a motor-driven transporting roller.

6. The guide pressure roller as claimed in claim 4, wherein the apparatus is part of a stacking device of an electrographic printing device.

7. An imaging machine comprising:

a mover moving the recording medium back and forth between a counter-bearing and a plurality of adjacently arranged pressure rollers which press the recording medium against the counter-bearing, the recording medium being guided on one side in edge perforations, wherein at least the outer pressure roller located opposite the edge perforations and resting on the recording medium is a guide pressure roller which changes its angle of the axis of rotation relative to the transporting direction corresponding to the transporting direction of the recording medium, said guide roller including a roller body;

a generally cylindrical roller axle on which said roller body rotatably bears; and a stationary axle extending through the roller axle in an eccentric position and on which the roller axle is mounted to be rotatable in a limited manner between two stop positions at which said roller axle engages a stationary holding block, a friction moment between the roller body and the roller axle being greater than a friction moment between the roller axle and the stationary axle so that, when a rotary movement of the roller body is reversed, the roller axle moves relative to the stationary axle between the stop positions before the roller body moves relative to the roller axle, the guide pressure roller having an axis of rotation which is self-changeable relative to said transport direction, each stop position corresponding to a respective orientation of the guide roller bearing on an axis of rotation which is non-perpendicular to the paper transport direction.

8. The guide pressure roller as claimed in claim 7, wherein the counter-bearing is a motor-driven transporting roller.

9. The guide pressure roller as claimed in claim 7, wherein the apparatus is part of a stacking device of an electrographic printing device.

10. A guide pressure roller frictionally contactable against a reversibly transportable paper, the guide pressure roller having an axis of rotation which self-adjusts to correspond to a transport direction of the paper, the guide pressure roller comprising:

a roller body contactable against the paper;

a roller axle on which the roller body rotatably bears; and a stationary axle extending through the roller axle on an eccentric axis relative to a central axis of the roller axle and on which the roller axle is rotatable between two stop positions at which positions said roller axle engages a holding block which is fixed relative to said stationary axle;

wherein a friction moment between the roller body and the roller axle is greater than a friction moment between the roller axle and the stationary axle so that when a direction of rotation of the roller body is reversed, the roller axle rotates on the stationary axle between the stop positions before the roller body rotates on the roller axle, each stop position corresponding to a respective orientation of the guide roller bearing on an axis nonperpendicular to the paper transport direction which frictionally tightens the paper.

11. The guide pressure roller as claimed in claim 10, wherein the roller axle includes two projections extending from one end thereof, and wherein the stationary axle is mounted to said holding block, the projections being contactable against said holding block at respective stop positions.

12. An imaging machine comprising:

a drivable feed roller for reversibly moving a paper selectively forward and backward transport direction;

at least one pressure roller contactable against the paper and pressing the paper against the feed roller, each pressure roller having a fixed axis of rotation;

at least one guide pressure roller frictionally contactable against the paper and pressing the paper against the feed roller, the guide pressure roller having a self-adjustable axis of rotation corresponding to the paper transport direction, the guide pressure roller having:

a roller body contactable against the paper;

a roller axle on which the roller body rotatably bears; and a stationary axle extending through the roller axle on an eccentric axis relative to a central axis of the roller axle and on which the roller axle is rotatable between two stop positions, said roller axle respectively engaging a stationary holding block at said stop positions;

wherein the friction moment between the roller body and the roller axle is greater than a friction moment between the roller axle and the stationary axle so that when a direction of rotation of the roller body is reversed, the roller axle rotates on the stationary axle between the stop positions before the roller body rotates on the roller axle, such that each stop position corresponds to a respective predetermined orientation of the guide roller bearing on an axis nonperpendicular to the paper transport direction.

13. The imaging machine according to claim 12 including at least one cooperating pair of guide pressure rollers, the guide pressure rollers of the pair being arranged near opposite edges of a side of the paper, the guide pressure rollers of the pair having oppositely oriented roller bearings such that the guide pressure rollers frictionally tighten the paper between them.

14. The imaging machine according to claim 12, wherein the paper has one edge with perforations along which the paper is guided, and wherein a guide pressure roller is located opposite the edge perforations.

15. The guide pressure roller as claimed in claim 12, further comprising a leaf spring on which each guide pressure roller is mounted.

* * * * *